United States Patent [19]

SanMiguel

[11] 4,410,230

[45] Oct. 18, 1983

[54] CONNECTOR BLOCK

[75] Inventor: Alfonso J. SanMiguel, Irvine, Calif.

[73] Assignee: Holmberg Electronics Corporation, Inman, S.C.

[21] Appl. No.: 475,467

[22] Filed: Mar. 21, 1983

Related U.S. Application Data

[63] Continuation of Ser. No. 298,453, Sep. 2, 1981, abandoned.

[51] Int. Cl.[3] ..... H01R 23/70

[52] U.S. Cl. ..... 339/176 M; 29/844; 339/17 LC; 339/275 B

[58] Field of Search ..... 339/17 C, 17 LC, 176 M, 339/218 R, 275 B; 29/844, 845

[56] References Cited

U.S. PATENT DOCUMENTS

| | | | |
|---|---|---|---|
| 2,871,551 | 10/1955 | Harris | 29/193.5 |
| 3,188,599 | 6/1965 | Roberts | 339/275 B |
| 3,288,915 | 7/1966 | Hatfield et al. | 174/94 |
| 3,696,319 | 10/1972 | Olsson | 339/17 F |
| 3,697,933 | 10/1972 | Black et al. | 339/17 LC |
| 3,883,212 | 5/1975 | Keglewitsch | 339/276 A |
| 4,008,941 | 2/1977 | Smith | 339/17 LC |
| 4,080,037 | 3/1978 | Kunkle et al. | 339/275 B |
| 4,183,610 | 1/1980 | Key | 339/221 R |
| 4,186,988 | 2/1980 | Kobler | 339/176 MP |

OTHER PUBLICATIONS

AMP, Inc. Catalog 79-546, issued 7/80, pp. 16-17.

*Primary Examiner*—John McQuade
*Attorney, Agent, or Firm*—Thomas Hooker

[57] ABSTRACT

A connector block includes terminals having contacts and channel shaped terminal tails with 90-degree bends and solder contacts on the ends of the tails.

25 Claims, 10 Drawing Figures

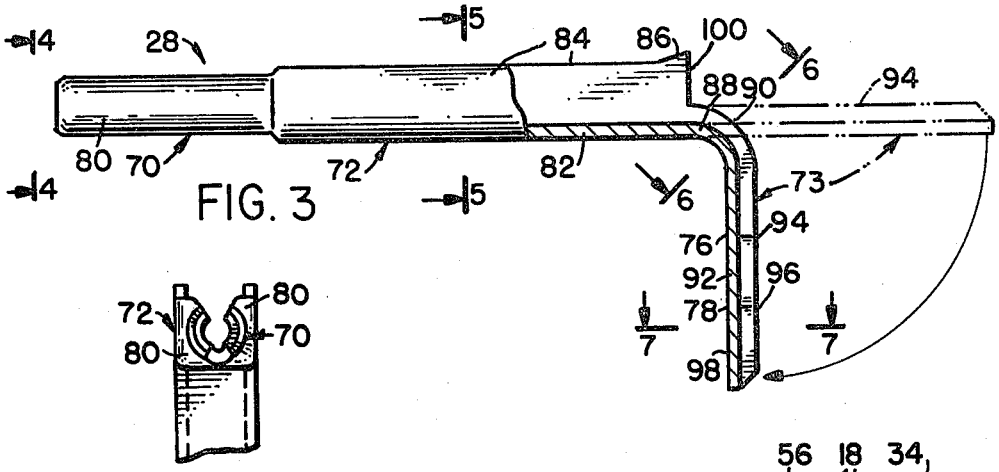
FIG. 3
FIG. 4
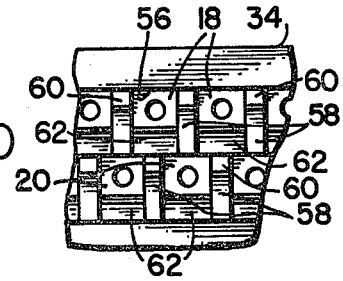
FIG. 10
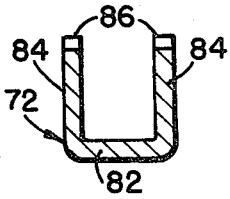
FIG. 5
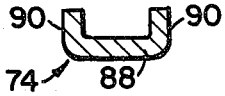
FIG. 6
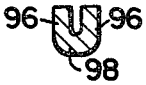
FIG. 7
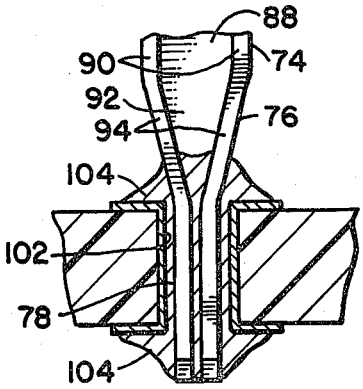
FIG. 8
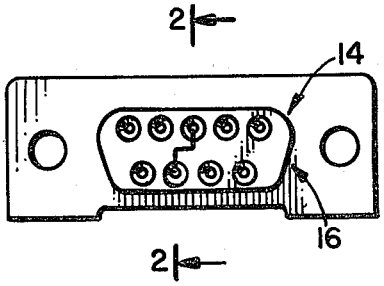
FIG. 9

CONNECTOR BLOCK

This application is a continuation of SanMiguel U.S. Ser. No. 298,453, for Connector Block, filed Sept. 2, 1981, now abandoned.

FIELD OF INVENTION

The invention relates to electrical connector blocks of the type solder-mounted on a circuit board or like substrate for establishing electrical connections with contacts carried on a plug.

DESCRIPTION OF PRIOR ART

In the electrical connector art it is conventional to mount connector blocks on circuit boards with terminals confined within the body of the block extending through and soldered to holes formed through the circuit board. The terminals in the connector block body include tails which extend from the body parallel to the board and are bent down 90 degrees to project into circuit board holes. The ends of the circuit board tails are arranged in a pattern which corresponds to the pattern of the circuit board holes so that when the block is mounted on the board the tails move freely into the holes for soldering. Connector blocks of this type are disclosed in U.S. Pat. Nos. 3,696,319; 3,697,933 and 4,186,988.

One of the problems with conventional board-mounted blocks is that the terminal tails are flimsy and are easily bent out of their proper position. Blocks with bent tails cannot be inserted into the circuit board holes.

A solution to the problem of flimsy circuit board tails is to provide a specialized plastic spacer which extends over the ends of the tails so that the tails are positively held in the desired pattern within the spacer. This type of spacer is shown at pages 16 and 17 of AMP, Incorporated Catalog 79-546, issued 7-80. The use of a tail spacer for assuring proper orientation of circuit board tails increases the expense of manufacturing and assembling the connector block and promotes undesired wicking of flux and molten solder into the block.

SUMMARY OF THE INVENTION

The connector block according to the invention includes a plastic insulating body with terminals having contact elements confined within the body and shallow channel shaped terminal tails extending outwardly of the body around a 90-degree bend and down into the circuit board holes. The channel shaped tails provide improved rigidity to assure that the solder contact portions at the free ends of the tails are accurately located in a pattern corresponding to the pattern of the circuit board holes, despite being exposed to usual lateral bending forces during assembly, shipping and loading which would bend conventional flimsy tails and move the ends from their proper locations. The tails include a flat bottom and upstanding side walls on the outside of the 90-degree bend. The channel shape at the bend and along the length of the tail provides the desired increased strength over conventional tails.

Other objects and features of the invention will become apparent as the description proceeds, especially when taken in conjunction with the accompanying drawings illustrating the invention, of which there are two sheets and one embodiment.

IN THE DRAWINGS

FIG. 3 is a side view, partially broken away, of one of the terminals in the block;

Figure 2:
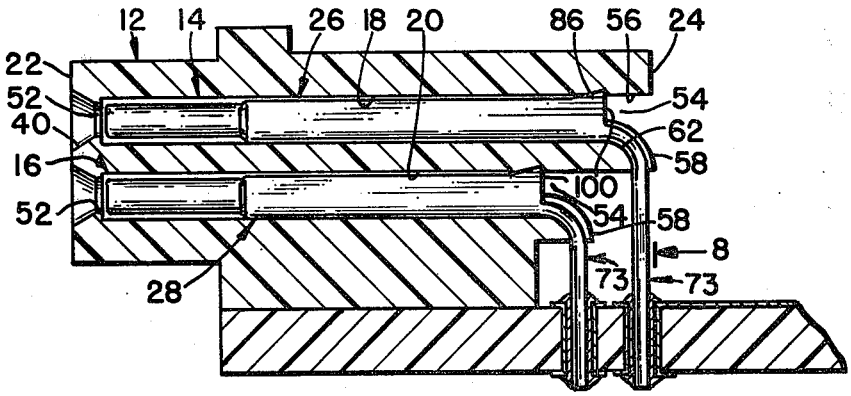
FIG. 2 is a sectional view taken through the block of FIG. 1 at line 2—2 of FIG. 9.

FIGS. 4, 5, 6 and 7 are views taken respectively along lines 4—4, 5—5, 6—6 and 7—7 of FIG. 3;

FIG. 8 is a view taken along line 8—8 of FIG. 2;

FIG. 9 is a front view of the connector block; and

FIG. 10 is a view of the back of the central portion of the block without terminals.

DESCRIPTION OF THE INVENTION

Connector block 10 includes an insulating body 12 preferably formed of a plastic material. The body has upper and lower rows 14 and 16 of open ended terminal cavities 18 and 20 extending between the front 22 and back 24 of the body 12. Upper terminals 26 are carried in cavities 18 and lower terminals 28 are carried in cavities 20. The cavities in the two rows are staggered across the width of the central portions of the body so that each cavity is between the adjacent cavities in the other row. See FIG. 10.

Integral board mounting wings 30 extend to either side of the body central portion 34 adjacent the bottom of the body. The block is mounted on circuit board 32 as shown in FIG. 2 by suitable connecting means, such as nuts and bolts, extending through mounting holes 36 and 38 extending through the wings and board. The body also includes two plug mounting wings 42 upstanding from the forward edges of wings 30 for securing plug 44 on block 10 with plug pins 46 in electrical connection with the terminals in cavity rows 14 and 16. The plug may be secured on block 10 by connecting means extending through holes 48 and 50 formed through the wings 42 and plug 44.

Each terminal cavity 18, 20 is rectangular in cross section from the back of the body to a lip 52 adjacent front 22. The lip is located at the inner end of pin lead-in 40. The lead-ins guide pins into the cavities to assure they mate with the contact portions of terminals 26 and 28.

As illustrated in FIG. 2, the upper cavities 18 extend rearwardly from the front of the body further than the lower cavities 20. Two slots 54 formed in the back of the cavity extend across the central portion 34. Each slot extends past a row of cavities and has a width of approximately one-half the height of the cavities. The top of the slot is defined by a surface 56 forming an extension of the top of the cavities in the row. The bottom of the slot is formed by a 90-degree downwardly curved surface 58 joining the slot side walls 60 approximately midway between the upper and lower slot surfaces. A series of 90-degree terminal grooves 62 are provided in the surfaces 58. The bottom of each groove forms an extension of the lower surface of the adjacent terminal cavity. The grooves are curved downwardly 90 degrees from the cavities to their ends so that the bottoms of the grooves parallel the adjacent surface 58. The depth of the groove 62 is approximately one-half the height of the terminal cavity. The curved terminal tail grooves 62 and lower slot surfaces 58 are preferably cylindrical about a common axis so that the depth of the grooves below the surface is maintained constant from the cavity side walls 60 to the end of the surface and grooves.

FIGS. 3 through 7 illustrate a lower terminal 28 as used in block 10. The terminal is preferably stamp formed from strip metal stock and includes a conventional bifurcated socket contact 70, a square deep channel section 72 extending coaxially away from the pin contact 70, and a terminal tail 73 including a 90-degree shallow channel tail portion 74, a reduced width transition portion 76 and a solder contact pin portion 78. The upper terminals 26 are identical to lower terminals 28 but have longer deep channel portions 72 and tails 73 so that the tails of the upper terminals are located behind the corresponding portions of the lower terminals and the pin portions of both terminals are at the same level. The upper terminal cavities 18 are correspondingly longer than lower terminal cavities 20 so that the slot 54 extending along the lower row of cavities 16 is spaced inwardly of slot 54 extending along the upper row of terminal cavities 14. The socket contact 70 of each terminal includes a pair of rounded contact arms 80 adapted to form a reliable low-resistance electrical connection with a contact pin 46. The contact arms 80 extend outwardly from one end of the deep channel section 72. This section includes a flat bottom wall 82 and two flat side walls 84 extending upwardly from the edges of the bottom wall. The side walls and bottom wall define a 90-degree deep channel having a square cross section. See FIG. 5. Lock barbs 86 project upwardly from the edges of side walls 84 to aid in confining the terminals in body 12.

The 90-degree shallow channel portion of each terminal tail includes a bottom wall 88 forming an extension of bottom wall 82. As illustrated in FIG. 3, the bottom wall 88 is bent down 90 degrees in a smooth curve from the level of bottom wall 82 and then extends straight down in a direction 90 degrees from the axis of portions 70 and 72. The shallow channel tail portion includes short 90-degree upstanding side walls 90 extending from side walls 84, around the 90-degree bend and to the transition portion 76. As shown in FIG. 6, side walls 90 have an exterior height somewhat less than one-half the exterior width of the bottom wall 88 so that the tail portion 74 has a shallow rectangular channel shape in transverse cross section.

The transition portion 76 of terminal 28 includes a flat bottom wall 92 of decreasing width and a generally triangular shape forming an extension of bottom wall 88 and converging upstanding short side walls 94 forming extensions of side walls 90. The solder contact pin portion 78 on the end of transition portion 76, as illustrated in FIG. 7, includes a nearly square U-bend of the strip stock forming terminal 28 with a pair of side walls 96 closely folded on each other, nearly touching adjacent inner sides and a 180-degree bend portion 98 joining the side walls.

Terminals 26 and 28 are inserted into their respective terminal cavities 18 and 20 with the end edges 100 of side walls 84 flush with the ends of side walls 60. The barbs 86 bite into the tops of the terminal cavities and hold the terminals in the cavities. The free ends of contacts 70 are located at collars 52 in position to form electrical connections with the pins in plug 44.

The 90-degree bends formed in bottom walls 88 rest flush on the bottoms of terminal tail grooves 62 with the upper edges of the short side walls 90 located a short distance below surface 58. The side walls may be flush with or spaced slightly inwardly of the sides of the grooves 62. As mentioned, the length of the straight part of portion 74 in the upper terminals 26 is greater than the length of the corresponding portion of the lower terminals 28 so that the transition and contact tail portions of the upper and lower terminals are located at the same with respect to the bottom of the block.

The terminals are preferably stamp formed from strip metal stock with the side walls folded up and the terminal tails extending straight from the deep channel portion 72. The tails are then bent down 90 degrees to provide the cylindrical bend illustrated in FIG. 3. During this operation the side walls 90 are stretched so that their thicknesses and height are reduced. The reduction in thicknesses of the side walls 90 may be as much as 10 percent of their original thickness.

In one version of block 10, the terminals 26 and 28 are stamped from 0.012 inch thick phosphor bronze stock. The outside width of the terminal channels from contact 70 to the transition portion 76 is 0.07 inch. The outside height of the deep channel section 72 is 0.07 inch and the outside height of the shallow channel section, before bending, is 0.0275 inch. The radius of the 90-degree bend in the terminals is 0.035 inch, as measured from the lower surface of bottom wall 88. At the bend of each terminal the outside height of the side walls is approximately 0.39 times the outside width of the bottom wall and the outside width of the bottom wall is about 5.8 times the thickness of the strip stock. The bend has a radius, as measured from lower surface of the bottom wall, of about 2.9 times the thickness of the strip stock.

In order to form the 90-degree bends in the terminal tails, it is necessary that the metal have sufficient ductility to avoid cracking. Preferably, the metal should have a 12- to 30-percent elongation as measured by the Americal Society for Testing Metals Federal Test Method Standard No. 151. Less ductile metals with a lower percent elongation crack during the formation of the 90-degree bend. More ductile metals with a greater elongation are not sufficiently strong.

Figure 1:
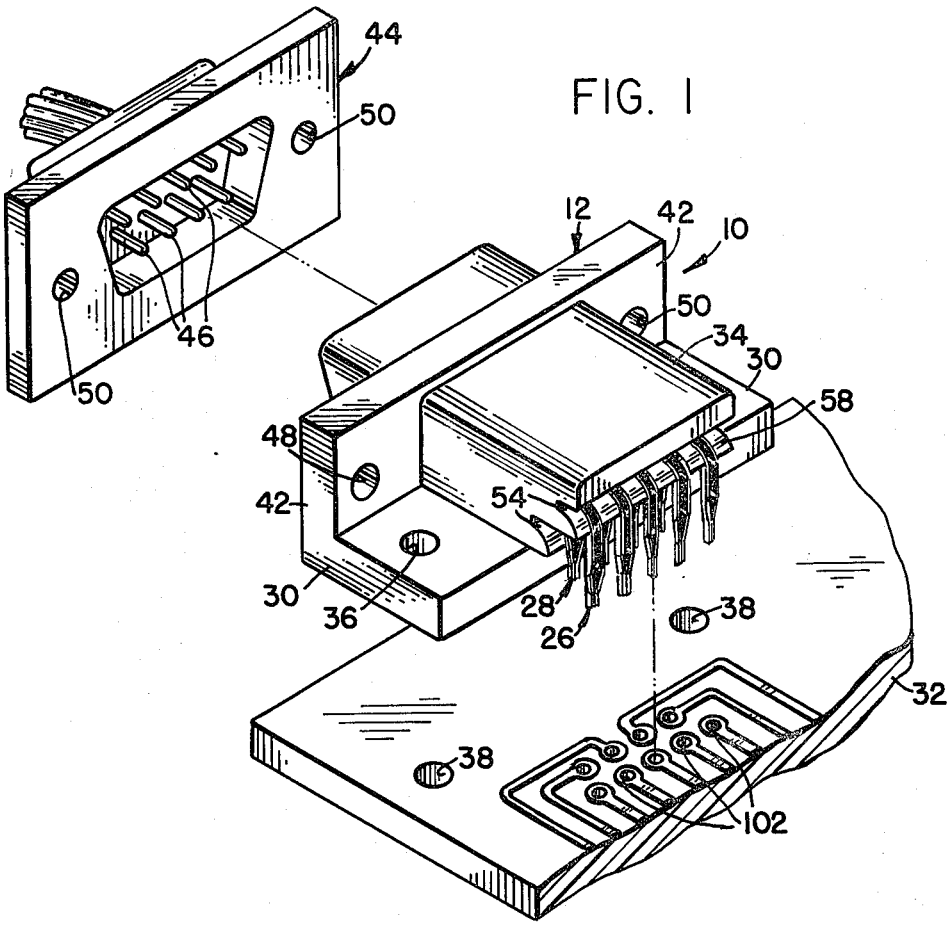
FIG. 1 is a perspective view illustrating a connector block of the invention, a circuit board on which the block is mounted and a plug for mating with the connector block.

Following insertion of the terminals 26 and 28 into body 12, as illustrated in FIGS. 1 and 2, the assembled block is mounted on circuit board 32 by moving the block so that the free ends of the contact pin portions 78 are above the plated circuit board holes 102 on the board. The block is then pushed toward the board to seat the tails in the holes. The pin portions of the upper and lower terminals are positioned in a pattern corresponding to the pattern of holes 102 on board 32. The bent channel shaped cross section of the terminals rearwardly of the deep channel portion 72 held within the body is rigid to assure that the pin portions 78 are accurately located in the desired pattern, despite being subjected to normally anticipated lateral forces during assembly, shipping and mounting on the board. These forces bend the tails of terminals used in conventional blocks of this type away from the design location. Such movement renders it difficult or, impossible to insert the tails into the circuit board holes. It is particularly important to assure terminal tails are accurately located when the blocks are mounted on boards by automatic assembly apparatus. A single misaligned pin could cause a jam and shut down the loading machine and an entire production line.

The channel shaped cross section of the terminals 26 and 28 around the cylindrical 90-degree bend assures rigidity at the bend, in contrast with terminals used in conventional blocks of this type where flat or round terminal stock is bent down 90 degrees. The upstanding side walls and the relatively wide bottom walls resist bending of the terminal tails between 90-degree bends and the pin portions.

Upon piloting of the pin portions into the holes 102, the body is positioned flush on the surface of board 32 and is secured in place by suitable mounting means extending through holes 36 and 38. The board is then soldered to form an electrical connection between each terminal and its respective circuit board 102 as illustrated in FIG. 8.

When soldered, the pin portion 78 of each terminal is secured electrically to the plating in its circuit board holes 102 by a solder connection including fillets 104 on both sides of the board. The divergence of side walls 94 above the board limits undesirable floux and solder wicking above the fillet area. The additional metal due to the widening of the bottom 92 acts as a heat sink and rapidly cools the molten solder after soldering to limit the upward flow.

The insulating body 12 is located a distance remote from the circuit board holes 100. Conventional connector blocks of the type illustrated use a separate plastic aligning member to hold the free ends of the terminals above the circuit board holes. The narrow channels between the member and the terminal tails and between the body and the member form solder and flux capillary flow paths which undesirably draw molten solder and flux above the circuit board. The rigid terminal tails of the present block do not need an aligning member and, accordingly, are free of this problem.

The terminals in the upper and lower rows of terminal cavities are staggered with respect to each other. Obviously, if desired, the terminals in the rows of cavities may be one above another, staggered or partially offset. Block 10 is provided with two rows of terminal cavities. The invention is not limited to the number of rows in the block and single row, two-row, or multi-row blocks are contemplated. The terminals 26 and 28 are described with a female contact portion 70 for reception of a male pin 46. The invention is not limited to the nature of the contact portion of the terminal and it is contemplated that the terminals include other types of contacts including male pins, abutting contacts or the like.

Upper and lower terminals 26 and 28 are stamp-formed from strip metal stock with the tail extending straight outwardly of the deep channel 72 as shown in dotted lines in FIG. 3. As stamped, the bottom walls 88 and 92 of the terminal tail form a flat, straight continuation of the bottom wall 82 of the deep channel. The terminal tail side walls extend upwardly 90 degrees from the bottom walls and form straight extensions of deep channel side walls 84.

The terminals are loaded into body 12 by first piloting the lead ends of lower terminals 28 into the lower terminal cavities 20 and then moving a blade with a flat pushing edge against the terminal edges 100 to push the terminals into the cavities until the blade bottoms on the lower cavity side walls 60. In this position, the terminal pin contacts and deep channel sections are seated in the body as shown in FIG. 2 and the terminal tails extend straight out of the back of the block. The portions of the terminal tails adjacent edges 100 are seated in the tops of the terminal grooves 62. The blades rests upon the top of surface 58 with its forward edge in the lower slot 54 abutting the ends of side walls 60.

The terminal tails are bent down 90 degrees by pivoting the blade downwardly about the curved lower slot surface 58 so that the shallow channel portions of the tails adjacent edges 100 are bent down into the 90-degree terminal tail grooves 62. The blade is rotated down slightly more than 90 degrees to give an overbend to the terminals thereby assuring that the terminals assume the desired 90-degree position when released.

Following loading and bending down of the lower terminals 28, upper terminals 26 are loaded and bent down in a similar manner. The curved surfaces 58 bend the tails about a radius of approximately 0.035 inch, in contrast to the sharp bends achieved when the tails in conventional blocks are bent down following insertion. Channel shaped tails cannot be bend down as sharply as conventional 90-degree tails.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim my invention is:

1. A connector block including a body formed of insulating material and adapted to be mounted on a surface, the body having a row of terminal confining cavities having ends opening on one side of the body; and a series of terminals formed from strip metal stock, each terminal including a cavity portion fitted within a cavity in the row of cavities to secure the terminal in the body, a contact joining the cavity portion for forming an electrical connection with a circuit element, and a terminal tail extending from the cavity portion outwardly of the opening in the cavity, the terminal tail including a solder contact on the free end thereof adapted to be soldered to a circuit element on the surface wherein the improvement comprises each terminal including a bottom wall, upstanding side walls running from the cavity portion to the solder contact and extending away from the bottom wall in the same direction to define a shallow channel shape in transverse cross section and a smooth bend in the tail between the cavity portion and the solder contact, the side walls projecting radially outwardly of the bottom wall at the bend whereby the terminal tails rigidly locate the solder contacts with respect to the body to facilitate positioning the solder contacts in a desired pattern for engagement with the circuit elements on the surface.

2. A connector block as in claim 1 wherein the body includes a terminal tail groove at the end of each terminal cavity, the bottom walls of such grooves conforming to the bottom walls of the terminal tail bend and the width of said grooves being slightly greater than the width of the terminal tail bend being seated within the grooves so as to provide additional support for the solder contact.

3. A connector block as in claim 2 wherein the body includes a slot extending across the ends of the terminal cavities in the row, one side of the slot comprising a curved surface, said terminal tail grooves being formed in said surface and having bottom walls generally equidistant below said surface.

4. A connector block as in claim 3 wherein the tops of the terminal tail side walls at the bend are below the curved side of the slot.

5. A connector block as in claim 1 wherein the bend in the terminals is about 90 degrees in extent.

6. A connector block as in claim 5 wherein the elongation of the metal in the bend of the terminal tails is between about 12% to 30% as measured by the American Society for Testing Metals Federal Test Method Standard No. 151.

7. A connector block as in claim 1 wherein for each terminal the thickness of the side walls at the bend is less than the original thickness of the strip metal stock.

8. A connector block as in claim 7 wherein the bend in the terminals is about 90 degress in extent.

9. A connector block as in claim 8 wherein at the bend of each terminal the outside height of the side walls is essentially uniform around the bend and such height is approximately 0.39 times the outside width of the bottom wall.

10. A connector block as in claim 8 wherein at the bend of each terminal the outside width of the bottom wall is about 5.8 times the thickness of the strip stock.

11. A connector block as in claim 8 wherein the smooth bend is generally cylindrical and has a radius, as measured from the lower surface of the bottom wall, of about 2.9 times the thickness of the strip stock.

12. A connector block as in claim 8 wherein the terminal tails are formed from strip stock having a thickness of about 0.012 inch, the outside width of the bottom wall at the bend is approximately 0.07 inch, the outside height of the side walls at the bend is approximately 0.0275 inch and the radius of the bend, as measured from the lower surface of the bottom wall is approximately 0.035 inch.

13. The method of assembling a connector block as in claim 3 including the steps of:

a. Inserting terminals into cavities with straight terminal channel shaped tails extending outwardly of the body parallel to each other with the tails extending through the portion of the terminal tail grooves adjacent the cavities;

b. Positioning a flat tool within the slot to overlie the terminal tails with the lead end of the tool on the bottom surface of the slot; and c. Pivoting the tool through a 90-degree angle against the bottom surface of the slot to bend the terminal tails down into the terminal tail grooves, elongate the terminal tail side walls in the grooves and form the smooth bend.

14. The method of assembling a connector block as in claim 13 including the step of moving the tool through an angle greater than the desired final angle of the bend to overbend the terminal tails and assure they assume the desired angle of bend when the tool is removed.

15. A stamped metal terminal formed from sheet metal stock, the terminal having a central portion with a contact for establishing electrical connection with a conductor at one end of the central portion and a terminal tail at the other end of the central portion, the terminal tail including a solder contact away from the central portion, the improvement comprising the terminal tail having a shallow channel shaped section in transverse cross section defined by a bottom wall and upstanding side walls, said channel shaped section extending from the central portion to adjacent the solder contact, and a smooth bend in the channel shaped section, the side walls of the terminal tail at the bend extending radially outwardly of the bottom wall whereby the section rigidly supports the solder contact with respect to the central portion.

16. A terminal as in claim 15 wherein the terminal tail is formed from a metal having about 12% to 30% elongation as measured by the American Society for Testing Metals Federal Test Method Standard No. 151.

17. A terminal as in claim 15 wherein the terminal tail side walls are thinner than the terminal tail bottom wall.

18. A terminal as in claim 17 wherein the terminal tail bend is approximately 90 degrees in extent.

19. A terminal as in claim 18 wherein the outside width of the terminal tail at the bend is about 5.8 times the outside thickness of the bottom wall of the terminal tail.

20. A terminal as in claim 18 wherein the central portion includes a bottom wall and side walls continuous with the terminal tail bottom wall and side walls, the terminal tail side walls having an outside height of approximately 0.39 times the outside width of the terminal tail bottom wall.

21. A terminal as in claim 18 wherein the bottom wall of the terminal tail bend is generally partially cylindrical in shape.

22. A terminal as in claim 18 wherein the radius of the bend in the bottom wall is about 2.9 times the thickness of the bottom wall at the bend.

23. A terminal as in claim 18 wherein the central portion includes a bottom wall and upstanding side walls, the side walls having an outside height equal approximately to the outside width of the bottom wall, the side walls and bottom walls of the terminal tail forming extensions of the central portion side walls and bottom wall, all of said side walls extending from the adjacent bottom walls at approximately 90 degrees, said terminal tail including a transition portion adjacent the solder contact having a bottom wall of decreasing width away from the central portion so that the transition portion side walls approach each other at the solder contact, the solder contact comprising a elongate U-bend with sides continuous with the sides of the transition portion.

24. A terminal as in claim 23 wherein said strip stock has a thickness of approximately 0.012 inch, the outside width of the terminal tail at the bend is approximately 0.07 inch, the radius of the bend in the bottom wall as measured from the lower surface of the bottom wall is about 0.035 inch and the outside height of the side walls at the bend is about 0.0275 inch.

25. A terminal as in claim 23 wherein said strip metal is made of phosphor bronze.

* * * * *

UNITED STATES PATENT AND TRADEMARK OFFICE

CERTIFICATE OF CORRECTION

PATENT NO. : 4,410,230

DATED : October 18, 1983

INVENTOR(S) : Alfonso J. SanMiguel

It is certified that error appears in the above—identified patent and that said Letters Patent is hereby corrected as shown below:

Column 2, lines 50-51 delete "formed in...cavity", and line 51 after "across" insert --the back of--.

Column 3, line 63 change "collar" to --lips--.

Column 4, line 7 after "same" insert --level--.

Column 5, line 4 after "between" insert --the--, line 11 after "board" insert --hole--, line 15 change "holes" to --hole--, line 17 change "floux" to --flux--, line 23 change "100" to --102--, and line 66 change "blades" to --blade--.

In the Claims:

Claim 1, column 6, line 39 delete the "," and substitute --and--.

Claim 2, column 6, lines 53 and 55 change "bend" to --bends--; and, line 57, change "contact" to --contacts--.

Claim 15, column 7, line 51 change "sheet" to --strip--; and, column 8, line 5 change "terminal tail" to --section--.

Claim 25, column 8, line 56 change "metal" to --stock--.

Signed and Sealed this

*Twentieth* Day of *March 1984*

[SEAL]

*Attest:*

GERALD J. MOSSINGHOFF

*Attesting Officer*

*Commissioner of Patents and Trademarks*

Disclaimer 4,410,230.—*Alfonso J. Sanmiguel,* Irvine, Calif. CONNECTOR BLOCK. Patent dated Oct. 18, 1983. Disclaimer filed June 25, 1984, by the assignee, *Holmberg Electronics Corp.*

Hereby enters this disclaimer to the entire term of said patent.

[*Official Gazette December 18, 1984.*]